US006659851B2

(12) United States Patent
Takahashi et al.

(10) Patent No.: US 6,659,851 B2
(45) Date of Patent: Dec. 9, 2003

(54) FASTENING DEVICE FOR POLISHING PAPER CLOTH

(75) Inventors: Yoshinobu Takahashi, Toyama-ken (JP); Toshiaki Takizawa, Toyama-ken (JP); Ryuichi Murasaki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/122,044

(22) Filed: Apr. 12, 2002

(65) Prior Publication Data

US 2002/0160703 A1 Oct. 31, 2002

(30) Foreign Application Priority Data

Apr. 19, 2001 (JP) ..... 2001-120582

(51) Int. Cl.[7] ..... B24B 23/00

(52) U.S. Cl. ..... 451/356; 451/351; 451/513; 451/525

(58) Field of Search ..... 451/351–356, 451/354, 495, 522, 524, 525, 358, 513

(56) References Cited

U.S. PATENT DOCUMENTS 3,192,678 A * 7/1965 Buratti
3,892,091 A * 7/1975 Hutchins
4,067,149 A 1/1978 Ali et al.
4,759,155 A * 7/1988 Shaw
5,402,559 A * 4/1995 Allison et al.
5,624,305 A * 4/1997 Brown ..... 451/354
6,186,878 B1 * 2/2001 Takizawa et al. ..... 451/357
6,379,236 B1 4/2002 Takizawa et al.

FOREIGN PATENT DOCUMENTS

| | | |
|---|---|---|
| EP | 0 925 876 A2 | 6/1999 |
| EP | 1 013 376 A2 | 6/2000 |
| JP | 2000-176818 A | 6/2000 |
| WO | WO 96/34721 | 11/1996 |
| WO | WO 98/19831 | 5/1998 |

* cited by examiner

*Primary Examiner*—Eileen P. Morgan
(74) *Attorney, Agent, or Firm*—Bell, Boyd & Lloyd LLC

(57) ABSTRACT

A fastening device for a polishing paper cloth of a portable polishing machine. The device comprises an attaching portion which can be detachably attached to a base plate of the polishing machine and a fastening device main body for winding the polishing paper cloth thereon to engage therewith. Multiple concave grooves, which are continuous in the winding direction of the polishing paper cloth in parallel, and a cavity portion formed inside are provided. Therefore, by giving flexibility to the main body to allow it to be deformed in many directions, it is possible to prevent a reaction to the operator due to oscillation of the polishing machine generated during the polishing and to improve a discharging function for the polishing waste to the outside by allowing the polishing waste generated during the polishing to easily intrude in the concave grooves. Additionally, during the polishing, the air from the outside is flown through the concave grooves so as to increase the contacts with the outside air, which enables to improve the discharge efficiency of the friction heat generated in the polishing.

9 Claims, 10 Drawing Sheets

FASTENING DEVICE FOR POLISHING PAPER CLOTH

BACKGROUND OF THE INVENTION

1. Field of the Invention

The present invention relates to a fastening device for a polishing paper cloth, which is to be attached to and detached from a polishing base plate of a portable polishing machine and on which surface the polishing paper cloth is mounted. Particularly, it relates to a fastening device for a polishing paper cloth which is applicable in a portable polishing machine of such a type that the polishing is carried out at a front end portion of its polishing base plate.

2. Description of the Related Art

Conventionally, a portable polishing machine has been used on many occasions so as to deal with various abrasive operations. One example of this portable polishing machine comprises a main body with a handle grip and has a configuration similar to that of an iron for household use, from which the base plate is detachable. An attaching portion of the base plate with respect to the polishing machine main body may be connected to an oscillation source, or alternatively the whole polishing operation may be performed manually. On a surface of a front end portion of the base plate, a detachment portion for a fastening device, which serves to detachably support a fastening device to which a male member of a surface fastener is fixed, is integrally formed.

One example of a fastening device for a polishing paper cloth to be used for this kind of a manual polishing machine is disclosed in Japanese Patent Application Laid-Open No. 2000-176818. The fastening device for a polishing paper cloth as disclosed in this publication is a molded product made of synthetic resin such as polyester elastomer resin and various hard rubbers. The fastening device of the polishing paper cloth comprises an attachment portion which is attachable to and detachable from a base plate of the polishing machine and a main body for winding and fastening the polishing paper cloth thereon. On the fastening device main body, a plurality of surface-fastener engaging element rows, which are arranged along a winding direction of the polishing paper cloth, are integrally formed so that it forms an engaging surface. The polishing paper cloth is fixed to the engaging surface by engaging a pile member (a female surface fastener) formed on a rear surface of the polishing paper cloth.

The attachment portion of the fastening device has a long and narrow cubic shape having a substantially trapezoidal cross section. The foregoing fastening device main body is integrally connected to a bottom surface of the attachment portion and it is comprised of a horseshoe-like body having such a cross section that is enclosed by a circumference of not less than a half circle and tangent lines contacting on the same circumference. From front and rear end surfaces of the fastening device main body up to a substantially central portion thereof, cavity portions, which are blind and have centers at a central line of the half circle cross section, are formed in the longitudinal direction. This cavity portions secure the flexibility by facilitating elastic deformation of the fastening device, which is made of hard resin so that it is necessary to provide it with some flexibility at least in the vicinity of the front and rear of the fastening device upon polishing.

In the meantime, in the polishing operation, the portable polishing machine carries out the operation by attaching the fastening device to which the polishing paper cloth is winded to be integrally engaged therewith, strongly pressing the main body portion of the fastening device to a surface of a work piece to be polished and then operating it along an exterior shape of the work piece. At that time, extremely strong oscillation acts on the fastening device due to the polishing machine in many directions. Therefore, although the oscillation of the polishing machine is transmitted to the hand, the arm and the like of an operator through the fastening device, the operator is obliged to strongly press the fastening device on the surface of the work piece against these oscillation. Thus, the operator gets more and more physically tired. Further, in the long run, the operator is given to suffering from a disease such as an inflammation or the like on his or her hand, arm and the like for a long term.

In general, if the fastening device is made of a material having flexibility, it is possible to suppress a reaction applied to the operator by absorbing the oscillation. However, the fastening device, which is disclosed in the above described Japanese Patent Application Laid-Open, is molded of synthetic resin having less elasticity such as polyester elastomer resin and various hard rubbers, so that it is difficult to sufficiently absorb the oscillation.

Therefore, according to the above described prior art, the fastening device is made so as to be easily deformed elastically by forming cavity portions in an interior of the fastening device main body around which the polishing paper cloth is to be winded and with which the polishing paper cloth is to be engaged, so that it is possible to secure the flexibility of the fastening device. However, the cavity portions are formed in the longitudinal direction of the fastening device as described above so that they positively can allow the elastic deformation in the front and rear directions of the fastening device main body by their structures, they can hardly allow the elastic deformation in the longitudinal direction of the fastening device main body. Therefore, depending on the material to be used for the fastening device, the flexibility is not sufficient only with these cavity portions, so that it becomes difficult to suppress the reaction acting on the operator by the oscillation of the polishing machine generated upon polishing.

Furthermore, in the polishing operation, the extremely large force acts on both of the fastening device main body and the polishing paper cloth in many directions as described above. Therefore, friction heat is generated not only when the polishing paper cloth and the work piece to be polished by this polishing paper cloth are in friction with each other but also when the fastening device main body and the polishing paper cloth are in friction with each other. This friction heat to be generated upon the polishing is transmitted to the fastening device main body through a portion where the fastening device main body and the polishing paper cloth are in friction with each other, so that the fastening device main body melts by this large amount of friction heat to be deformed into an irregular shape.

Still further, according to the above described prior art, the fastening device main body has a plurality of surface-fastener engaging element rows which are integrally formed on a portion thereof directly serving the polishing so as to form an engaging surface. In this case, an non-engagement area, which has no engaging elements, is formed between the engaging element rows of the surface fastener. When the polishing operation is not carried out, a rear surface of the polishing paper cloth is engage with the engaging surface locally in such a manner that it is detached from the non-engagement area of the fastening device main body. Therefore, the polishing paper cloth does not positively is not in contact with the non-engagement area of the fastening device main body.

However, in the polishing operation, if the polishing operation is carried out by strongly pressing the fastening device to the work piece to be polished and operating it along the exterior shape of this work piece, the non-engagement area of the fastening device main body and the rear surface of the polishing paper cloth necessarily contact with each other by the pressing force. As a result, a gap between the fastening device main body and the rear surface of the polishing paper cloth is closed so as to shut off the outside air and block the ventilation, so that the heat radiation from the rear surface of the fastening device and the polishing paper cloth to the exterior becomes insufficient.

Still further, if the polishing waste or the like generated during the polishing operation intrude in a gap between the front surface of the fastening device main body and the rear surface of the polishing paper cloth from a longitudinal side edge portion of the fastening device main body to be accumulated without being discharged to the outside, the non-engagement area between the plurality of surface-fastener engaging element rows, which are formed on the engaging surface of the fastening device main body, gets clogged, so that the engagement of the fastening device main body and the polishing paper cloth is obstructed and the engagement force of the fastening device main body is decreased. As a result, the polishing paper cloth gets stripped off from the fastening device main body. Furthermore, if the polishing waste or the like intrudes in the gap between the front surface of the fastening device main body and the rear surface of the polishing paper cloth, both of the fastening device main body and the polishing paper cloth are rubbed with each other by a large frictional force due to the polishing waste or the like. Then, this frictional force generates heat, so that the fastening device main body is apt to melt and it is deformed into an irregular shape in a short period.

SUMMARY OF THE INVENTION

The present invention has been made taking the above conventional problems into consideration. Specifically, an object of the invention is to provide a flexibility to a fastening device main body of a fastening device, which is given to being easily deformed in many directions, as well as to provide a fastening device for a polishing paper cloth of a polishing machine which enables to prevent the deformation by heating and prevent clogging of the fastening device due to the polishing waste or the like generated in the polishing operation, so that it is possible to maintain a holding power of the polishing paper cloth with respect to the fastening device main body for a long term.

A basic feature of the present invention is in a synthetic-resin-made fastening device for a polishing paper cloth comprising, on a fastening device main body thereof, an attaching portion capable of being detached from and attached to a base plate of a polishing machine; and an engaging surface for winding the polishing paper cloth thereon to engage therewith, wherein the fastening device main body has a plurality of concave grooves on a surface thereof.

In this case, it is possible to apply common synthetic resins, which have been conventionally used, to the fastening device for a polishing paper cloth according to the present invention. As the material of this fastening device, for example, various thermoplastic elastomer resins and a synthetic rubber, which are excellent in heat resistance, weather resistance, metallic contact deterioration resistance and formability, can be applied.

On the engaging surface of the fastening device main body to be attached to the base plate of a polishing machine, for example, a plurality of surface-fastener engaging elements are integrally molded. Then, the polishing paper cloth is engaged with these surface fastener engaging elements to be united thereto, so that the polishing operation can be carried out. In this case, very large oscillation from the polishing machine acts in many directions and is transmitted to the hand, the arm or the like of the operator. Therefore, the reaction to act on the operator becomes very large. According to the present invention, a plurality of concave grooves are formed in an non-engagement area, which is located on a front surface of the fastening device main body and in which no surface-fastener engaging elements exist, and flexibility is given to the fastening device main body, which allows the fastening device to be easily deformed in many directions. As a result, the reaction to the operator due to the oscillation of the polishing machine generated in the polishing operation is effectively decreased.

It is preferable that the concave grooves are continuous in a winding direction of the polishing paper cloth.

In general, in the polishing operation according to the polishing paper cloth, the engaging surface and the rear surface of the polishing paper cloth, and the front surface of the polishing paper cloth and a work piece are repeatedly rubbed with each other, so that friction heat is generated, which make the temperature of the polished surface very high, and this heat is transmitted to the fastening device main body. As a result, the fastening device main body itself also reaches a high temperature. It is necessary that each of the concave grooves, which are continuous in the direction of the winding of the polishing paper cloth, has a width and a depth to an extent that they do not contact the polishing paper cloth even during the polishing. Owing to such a shape of the concave groove, the outside air can be flown through the concave grooves even during the polishing, so that it is possible to effectively discharge a large amount of friction heat, which is generated due to the repetition of the rubbing, to the outside and to secure a cooling function for improving the discharge efficiency of the friction heat generated in the polishing.

Further, the concave groove also serves as a chip pocket for facilitating the discharge of the polishing waste or the like of the polishing paper cloth and the work piece. A part of the polishing waste or the like, which is generated in polishing, is efficiently discharged to the outside through the continuing concave grooves by the oscillation of the polishing machine. Accordingly, it is possible to prevent clogging due to adhesion of minute polishing waste and any damage of a surface to be processed during the polishing, as well as it is possible to maintain a good engagement force of the polishing paper cloth with respect to the engaging surface of the fastening device main body for a long term.

Further, as described above, since a part of the polishing waste by the polishing operation easily can easily intrudes in the concave grooves and at the same time and it is efficiently discharged to the outside by the oscillation of the polishing machine, an increase of the friction heat, which is to be generated when the engaging surface s of the fastening device main body and the rear surfaces of the polishing paper cloth or the like are rubbed with each other through the polishing waste with a large friction force, can be suppressed to the utmost. As a result, it becomes possible to prevent the deformation of the fastening device main body due to the large amount of friction heat, so that the polishing with respect to the work piece can be carried out smoothly.

Furthermore, it is preferable that other than the concave grooves, the fastening device main body has another concave groove on a lower surface thereof.

Normally, at the time of the polishing operation, the fastening device main body is pressed to a surface of the work piece as strong as possible and operated along the exterior shape of the work piece. Therefore, it is the lower surface of the fastening device main body that is pressed most strongly on the surface of the work piece during the polishing operation. Thus, concave groove other than the above-described concave grooves is further formed at least on a lower surface of the fastening device main body that is most affected by the polishing. This other concave groove, for example, communicate with the concave grooves continuous in the winding direction of the polishing paper cloth, so that it provides flexibility to the fastening device main body itself, as well as it allows a part of the minute polishing waste or the like generating in polishing to easily intrude in the lower surface of the fastening device main body. Further, it has a discharging function to allow the minute polishing waste or the like to be smoothly circulated upwardly from the lower surface of the fastening device main body by the oscillation of the polishing machine and to be discharged to the outside. Therefore, the fastening device main body prevents the clogging due to the adhesion of the minute polishing waste and the friction heat or the like during the polishing operation from being generated.

Still further, it is preferable that the concave groove formed on the lower surface of the fastening device main body is continuously elongated over opposite side surfaces of the fastening device main body.

The concave groove, which is continuously elongated over the opposite side surfaces of the fastening device main body, is formed on the lower surface of the fastening device main body, which is most affected by the polishing and easily reaches to a high temperature. Owing to this concave groove, the discharge ratio and the cooling efficiency of the polishing waste are improved, and the clogging due to the adhesion of the minute polishing waste can be efficiently prevented. At the same time, the fastening device main body is not subject to deformation due to the friction heat during the polishing. As a result, it is possible to secure a required engagement force with respect to the polishing paper cloth even against the large force applied in many directions, as well as to improve the polishing efficiency. Thus, it is possible to perform the polishing with a high degree of accuracy for a long term.

It is preferable that the fastening device main body has a cavity portion opening at opposite end surfaces in a longitudinal direction thereof and that a thickness between the cavity portion and the engaging surface is substantially equal in the winding direction of the polishing paper cloth.

In the case that a constituent material of the fastening device main body is a hard synthetic resin or a hard rubber, the polishing paper cloth lineally acts on a surface to be polished during the polishing, which makes the polishing efficiency decreases. Therefore, according to the present invention, the thickness between the cavity portion and the engaging surface is formed to be substantially equal in the winding direction of the polishing paper cloth, so that the fastening device main body is capable of obtaining easy and uniform elastic deformation at any position on its surface. Hereby, an acting area of the polishing paper cloth with respect to the surface to be polished is increased, so that the polishing efficiency is improved. The degree of the elasticity can be changed by adjusting the size of the cavity portion.

In addition to the existence of the cavity portion, because the above described concave groove is formed, even if the large outer force acts on the fastening device main body in many directions, the fastening device main body can be easily deformed so that it is possible to secure the entire flexibility of the fastening device main body and to keep suppressing the reaction to be applied to the operator by the oscillation of the polishing machine generated during the polishing.

It is preferable that the cavity portion is partitioned at a center portion in the longitudinal direction of thereof by a vertical wall.

Since the fastening device main body is strongly pressed against the surface be polished in many directions during the polishing, the fastening device main body easily reaches a high temperature. Therefore, the fastening device easily changes its elastic deformation to a plastic deformation only with a mere cavity portion being formed on the fastening device main body, or it may be easily worn out, so that the fastening device main body can become flat. Particularly, since the above described worn-out is quite large at the center portion of the fastening device main body, it is preferable to secure rigidity at the center portion of the longitudinal direction of the fastening device main body while keeping the elasticity at its end portions, as well as to increase the strength, by partitioning the center portion of the longitudinal direction of the cavity portion with a vertical wall, as in the present invention. Due to this partition, the strength of the fastening device main body is appropriately increased, so that, even if large external force acting in many directions is applied, it is possible to maintain the durability of the polishing capability while keeping a required shape.

It is preferable that an interior of the cavity portion is further partitioned by a horizontal wall.

Said cavity portion is formed with the above described vertical wall at its center portion in the longitudinal direction, and it is further formed with a horizontal wall on a horizontal plane along a center line of the cavity portion. In other words, the inner cavity is divided into four chambers, i.e., upper, lower, right and left chambers by the partition walls forming a cross shape, in a side view of the fastening device. In the polishing, because the fastening device is strongly pressed so that it is easily deformed in many directions, it is necessary to appropriately increase the strength of the fastening device main body. Particularly, the above described horizontal wall provides appropriate elasticity to the fastening device main body while restricting the deformation of thereof in a direction orthogonal to a pressing direction. Therefore, it is possible to keep a required shape and to secure the polishing capability in cooperation with the vertical wall.

DESCRIPTION OF EMBODIMENTS

Embodiments according to the present invention will be specifically explained with reference to the accompanying drawings below.

Figure 1:
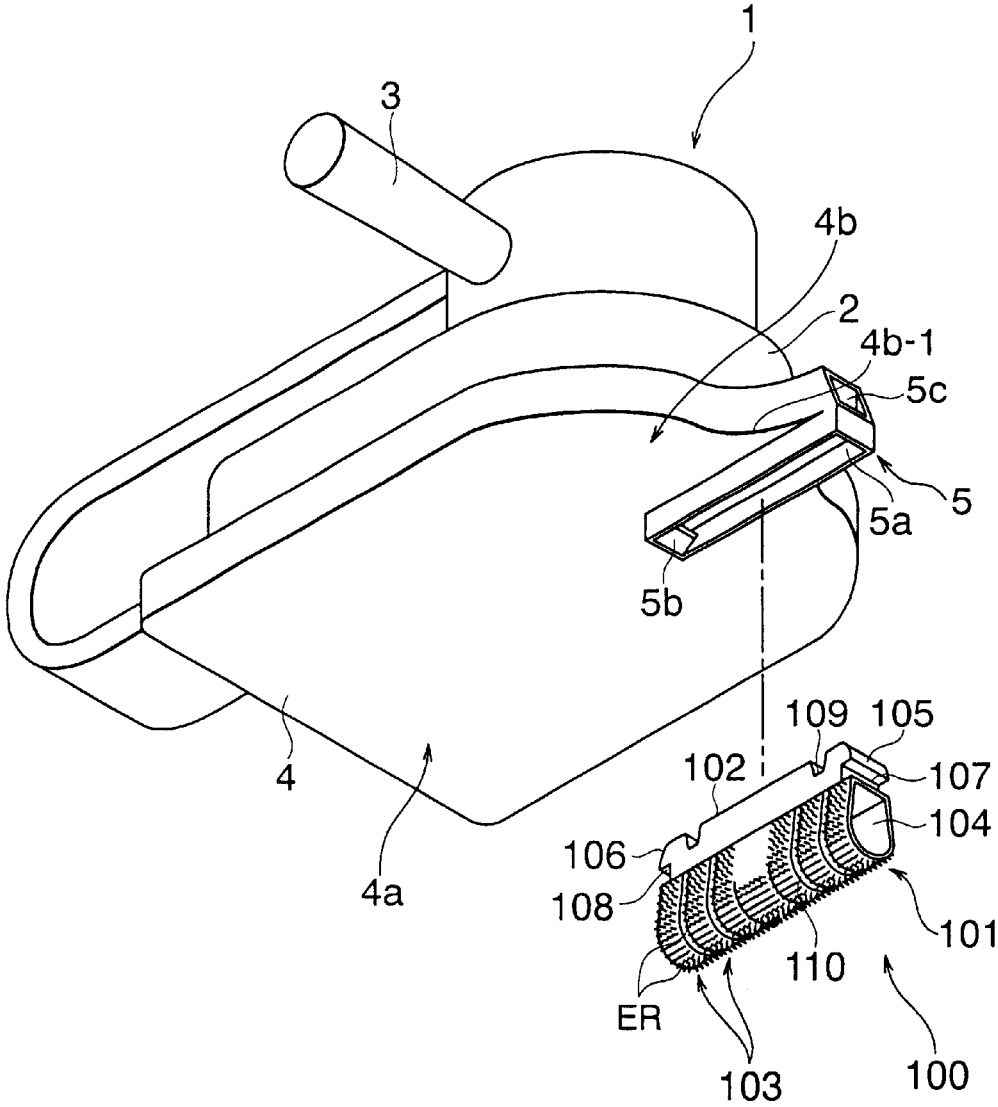
FIG. 1 is an exploded perspective view of a portable polishing machine as a typical embodiment, to which a fastening device for a polishing paper cloth according to the present invention is applied and the present fastening device.

FIG. 1 shows a schematic constitution of a portable polishing machine as a typical embodiment according to the present embodiment. In FIG. 1, the reference numeral 1 denotes a portable polishing machine. This portable polishing machine 1 shown in FIG. 1 has a main body 2 provided with a handle 3 and is a manual type without an oscillation generating device in an interior of the body 2. It is a matter of course that the present invention is not limited to a manual type but also it can be applied to an automatic polishing machine having an electromagnetic oscillation generating device mounted in the interior of the main body.

On a lower surface of the body 2, a flat plate-like metal-made base plate 4 is fixed. The base plate 4 may be made of synthetic resin. As shown in FIG. 1, the base plate 4 has a shape of a plate in which a rectangular portion 4*a* (hereinafter, referred to as a base plate posterior part) is formed continuous to a substantially isosceles triangle portion 4*b* (hereinafter, referred to as a base plate anterior part) with an acute corner portion 4*b*-1 at its front end are connected. On a lower surface of the base plate anterior part 4*b*, there is formed an attachment and detachment portion 5 for a fastening device having an attachment and detachment space 5*a* for the fastening device, which is long and narrow in the longitudinal direction and which is surrounded by rectangular wall portions within a range from the acute corner portion 4*b*-1 at its front end substantially to a border line between the base plate posterior part 4*a* and the anterior part 4*b*. The back and forth wall surfaces of the attachment and detachment portion 5 for a fastening device has an engaging nail 5*b*, which protrudes inwardly in a form of wedge and which one end of a fastening device 100 according to the present invention is engaged with and detached from. Further, a fitting hole 5*c* for fitting and supporting the other end of the fastening device is formed in a range from a front wall portion of the attachment and detachment portion to a front end surface of the base plate 4. Such a structure is substantially the same as a conventional one.

The fastening device 100 for a polishing paper cloth according to the present invention is comprised of a molded product made of synthetic resin. Further, the fastening device comprises an attaching portion 102, which is capable of being attached to and detached from the attachment and detachment space 5*a* of the attachment and detachment portion 5 of the fastening device formed on the base plate 4 of the polishing machine 1, and a fastening device main body 101 for winding a polishing paper cloth 11 thereon to engage therewith. On a front surface of this fastening device main body 101, there is provided an engaging surface 103, on which a plurality of surface fastener engaging element rows ER along in a winding direction of the polishing paper cloth 11 are integrally molded. As a material composing the fastening device 100, polyester elastomer resin and various hard rubbers may be applied. Particularly, thermoplastic elastomer resin, which is excellent in heat resistance, weather resistance, metallic contact deterioration resistance and formability, is preferable.

As shown in FIG. 1 to FIG. 5, a shape of the attaching portion 102 of the fastening device 100 according to the present embodiment is a long and narrow cubic shape of a substantially trapezoidal section. The foregoing fastening device main body 101 is integrally connected on a bottom surface of the attaching portion 102 and it is comprised of a horseshoe-like shape having a section which is enclosed by a circumference not less than a half circle and tangent lines contacting on the same circumference. On the fastening device main body 101, a cavity portion 104 opening at its back and forth end surfaces is formed between the main body and the engaging surface 103 and having a substantially equal thickness along the winding direction of the polishing paper cloth 11.

With such a shape, the fastening device main body 101, which is strongly pressed to a work piece during the polishing, requires flexibility in order to absorb the oscillation generated by the polishing. Therefore, by forming the cavity portion 104 as described above, the fastening device main body 101 is easily deformed uniformly along its front surface, so that it is possible to secure a required flexibility. A degree of the flexibility can be adjusted by changing a hole diameter of the cavity portion 104 or a partition wall of the cavity portion 104, which will be described later. In addition, the shape of the cavity portion 104 is not limited to the above described one but it may be merely a cavity having a circle section.

Figure 4:
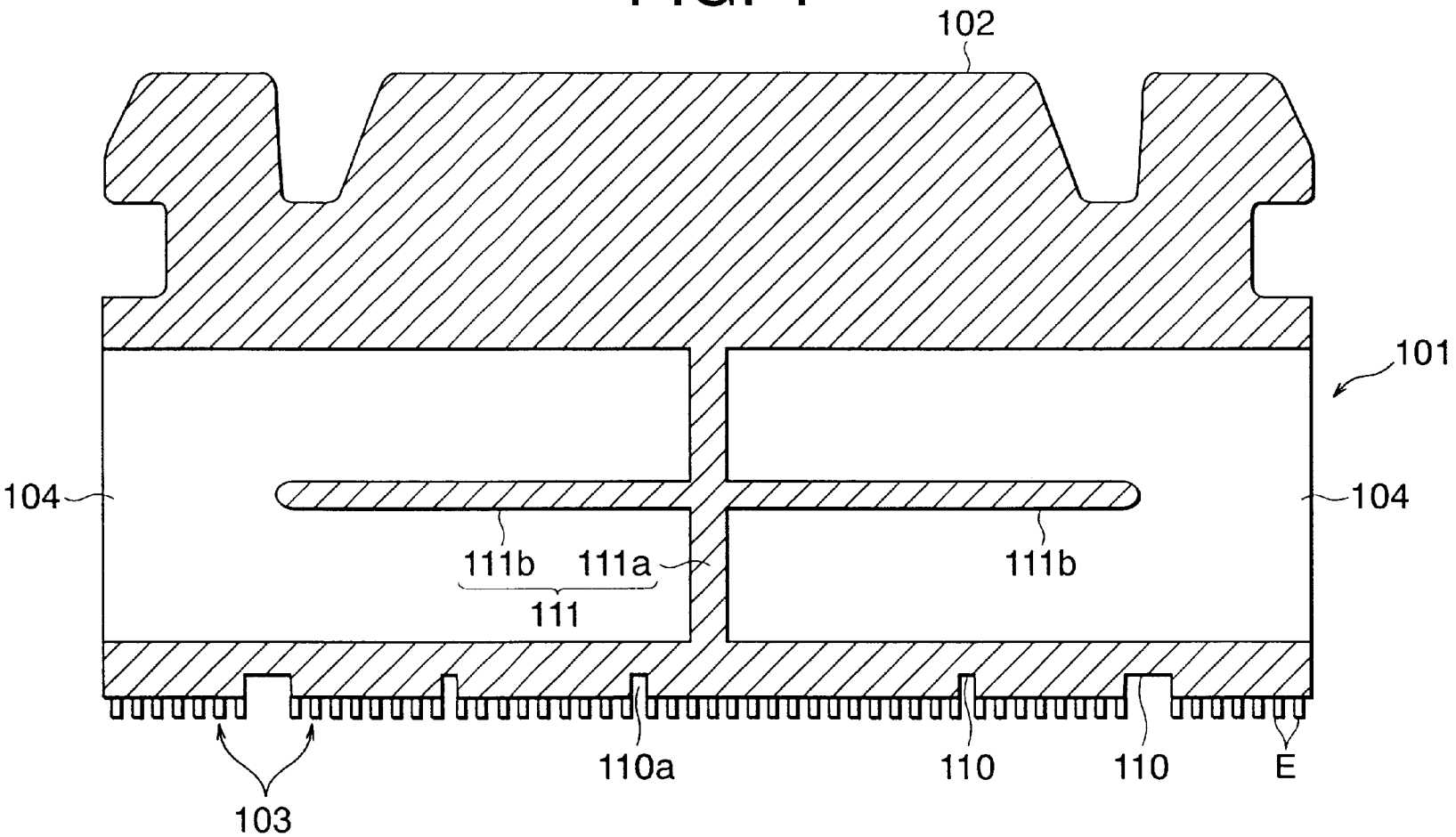
FIG. 4 is an arrow sectional view taken along the II—II line in FIG. 2.

According to the present invention, as shown in FIG. 4, in the interior of the cavity portion 104, a vertical wall 111*a* is formed at a substantially center portion in a longitudinal direction of the fastening device main body 101 and a horizontal wall 111*b* is formed in a range from the vicinity of the opposite end surfaces in the longitudinal direction of the fastening device main body 101 to the vertical wall 111*a*. In other words, the cavity portion 104 is divided into four chambers, i.e., upper, lower, right and left chambers by a partition wall 111 in a cross shape in a side view of the fastening device 100. The fastening device main body 101 is most easily deformed since the outer force is strongly applied against the engaging surface 103 in many directions during the polishing, which makes it necessary to apply required elasticity to the fastening device main body 101 while appropriately increasing the strength of the fastening device main body 101. Therefore, with this partition wall 111, it is possible to secure a polishing capability while keeping a required shape against a large outer force acting in many directions.

Alternatively, on the opposite end portions in a longitudinal direction of the attaching portion 102, a pair of back and forth engaging projections 105 and 106, which have the same shapes attachable and detachable with respect to the attachment and detachment space 5*a* of attachment and detachment portion 5 of the fastening device formed on the base plate 4 and project in the opposite directions, are provided. According to the illustrated example, the projecting end surface of each of the engaging and disengaging projections 105 and 106 is on the same plane as the back and forth end surfaces of the fastening device main body 101. Accordingly, in this embodiment, each of the engaging and disengaging projections 105 and 106 is formed by forming a groove 107 or 108, which is elongated in right and left directions on an end surface of a border portion between the attaching portion 102 and the fastening device main body 101.

Further, on the opposite side from an projecting end surface of each of the engaging and disengaging projections 105 and 106, a groove 109, which is elongated in right and left directions like the grooves 107 and 108, is formed. The groove 109 provides a required flexibility to the projections 105 and 106, so that the projections 105 and 106 can be easily deformed elastically when the projections 105 and 106 are engaged with and detached from the fitting hole 5*c* and the engaging nail 5*b* formed in the vicinity of the attachment and detachment portion 5 of the fastening device.

In addition, at a front end of each of the projections 105 and 106, there may be formed a penetrating hole in a direction orthogonal to a projecting direction of the projections 105 and 106 so that the front ends of the respective projections 105 and 106 may be easily deformed elastically.

Figure 3:
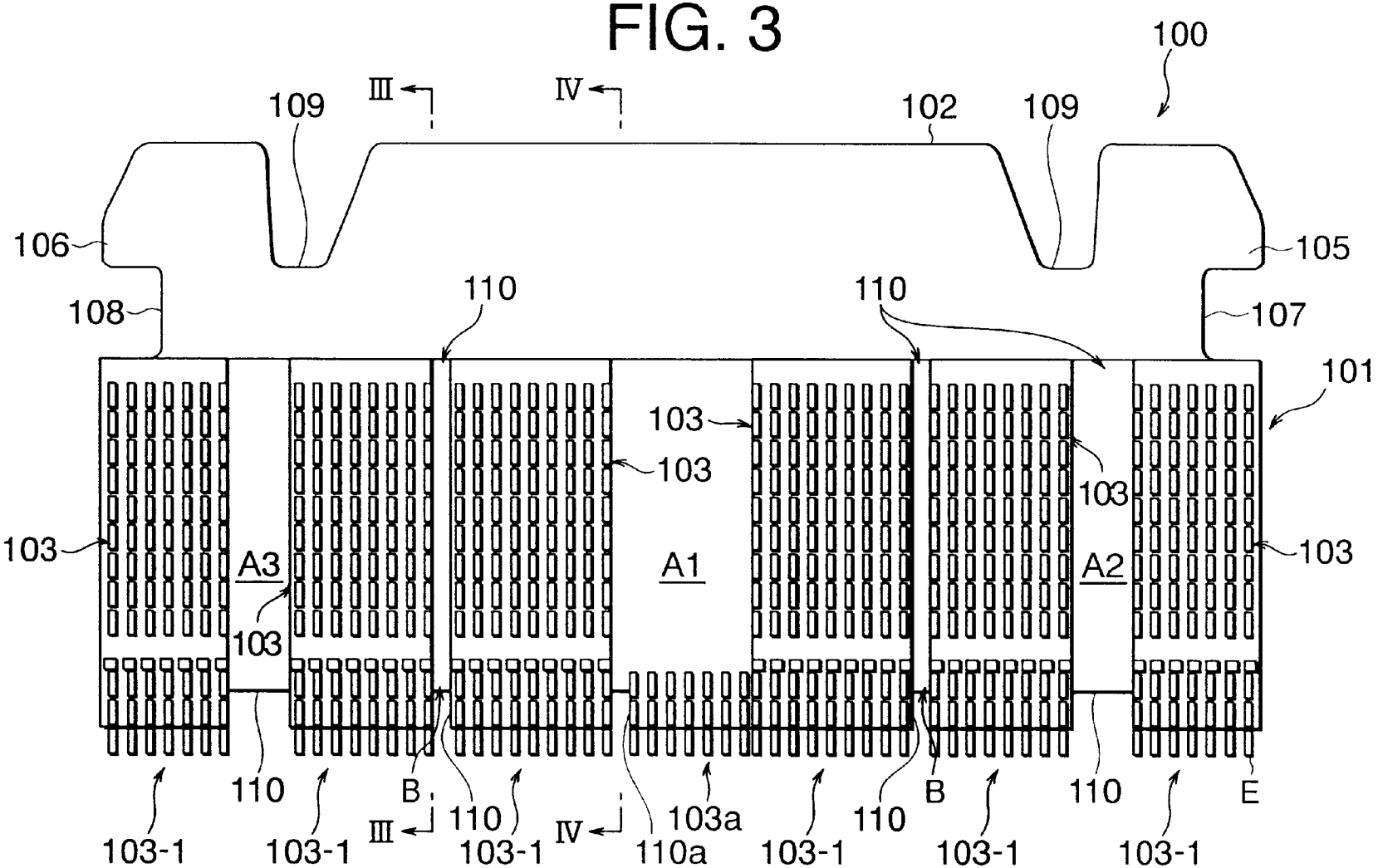
FIG. 3 is a side view of the fastening device.

Further, according to the present embodiment, as shown in FIG. 1 and FIG. 3, the engaging surface 103 has a plurality of surface fastener engaging element rows ER molded integrally on the fastening device main body 101. The surface fastener engaging element rows ER, which comprise multiple hook-shape engaging elements E that are linearly arranged in the winding direction of the polishing paper cloth on a surface of the fastening device main body 101, are arranged in the longitudinal direction and integrally molded. Therefore, the engaging surface 103 is formed by groups of surface fastener engaging element rows with non-molded areas (non-engagement area) A in which no hook-shaped engaging elements E are formed being interposed therebetween.

According to the illustrated example, wide non-engagement areas A1 to A3 are formed at a center portion of right and left side surfaces (the back and forth surfaces in a direction orthogonal to a paper surface of FIG. 3) of the fastening device main body 101 and three positions in the vicinity of back and forth end portions (right and left positions in FIG. 3) in a longitudinal direction thereof. Further, there are narrow non-engagement areas B and B between the non-engagement area A1 located at the center portion and the non-engagement areas A2 and A3 at the back and forth end portions, respectively. Four engaging surfaces 103 are formed so as to interpose the non-engagement area A1 at the center portion and the narrow non-engagement areas B, as well as two engaging surfaces 103 are formed adjacent to the vicinity of the wide non-engagement areas A2 and A3 at the back and forth end portions. The numbers of the surface fastener engaging element rows ER, which are arranged on the respective engaging surfaces 103, are respectively nine, eight and seven in the back and forth directions from the non-engagement area A1 at the center portion.

Furthermore, on a lower surface of the fastening device main body 101, an engaging surface 103-1, which has the number of rows corresponding to that of the respective engaging surfaces 103, is formed adjacent to the engaging surfaces 103 of six groups in total with horizontally extending non-engagement areas C being interposed. Further, on a lower surface of the non-engagement area A1 of the fastening device main body 101, an engaging surface 103*a*, which is comprised of seven surface fastener engaging element rows ER, is formed.

Further, according to the present embodiment, on all areas of the other non-engagement areas A2, A3 and B except for the non-engagement area A1 at the center portion, concave grooves 110, each of which has the same width as that of each of these areas A2, A3 and B, is formed over an entire periphery in the winding direction of the polishing paper cloth. Furthermore, according to the present embodiment, a concave groove 110*a*, which is linearly elongated in a direction crossing the fastening device main body 101 (i.e. an orthogonal direction to FIG. 3), is formed on a partial missing portion of the engaging surface 103-1 arranged on a lower surface of the non-engagement area 1 at the center portion. These concave grooves 110 and 110*a* constitute a characteristic part of the present invention. It is possible to set these concave grooves 110 and 110*a* at required width and depth such that they do not contact the polishing paper cloth 11 during the polishing processing. Thus, they are not limited to the example shown in the drawing. However, as described later, it is necessary that these concave grooves 110 and 110*a* provide required elasticity to the fastening device main body 101 as well as they have a function to discharge friction heat generated upon polishing to the outside for cooling and a function to discharge the polishing waste or the like to the outside.

Figure 2:
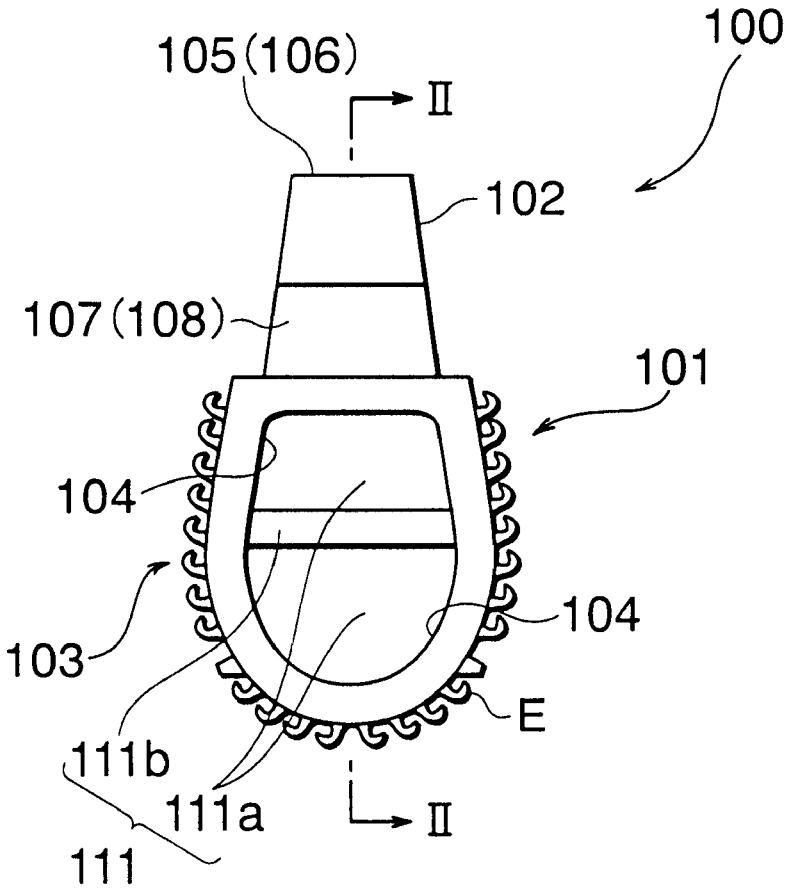
FIG. 2 is a front view of the fastening device.

In the respective surface fastener engaging element rows ER of the engaging surfaces 103 which are formed on right and left side surfaces of the fastening device main body 101 (i.e., back and forth surfaces in a direction orthogonal to FIG. 3), eight hook-shape engaging elements E are arranged with their hooks orienting in an upward direction as shown in FIG. 2. With such arrangement, the hooks are directed in the winding direction of the polishing paper cloth 11, so that it is possible to obtain reliable engagement, by which the polishing paper cloth 11 does not come off. Furthermore, in the surface fastener engaging element rows ER arranged on the lower surface of the fastening device main body 101, the directions of the hooks of the hook-shape engaging elements E are directed upwards along the peripheral direction by dividing the rows from the lowest end of the main body as a start point.

The force acts on the polishing paper cloth 11, which is engaged with the engaging surfaces 103 formed of the surface fastener engaging element rows ER in the respective groups, during the polishing. Therefore, the outer force in many directions also acts on the hook-shape engaging elements E that are engaging and fixing the polishing paper cloth 11. Accordingly, it is also necessary for the engagement force between the polishing paper cloth 11 and the engaging surface 103 comprised of the hook-shape engaging elements E to have such a sufficient strength as being capable of resisting the force in many directions. Therefore, reinforcement ribs may be provided so as to project by being integrally molded to the fastening device main body 101 on the side surfaces in the direction orthogonal to the hook directions of the hook-shape engaging elements E. Furthermore, as the present embodiment, by reversing the directions of the hooks of the surface fastener engaging element rows ER, it is possible to secure sufficient engagement force to resist the force in a removing direction of the polishing paper cloth 11 with respect to the engaging surface 103.

Figure 5:
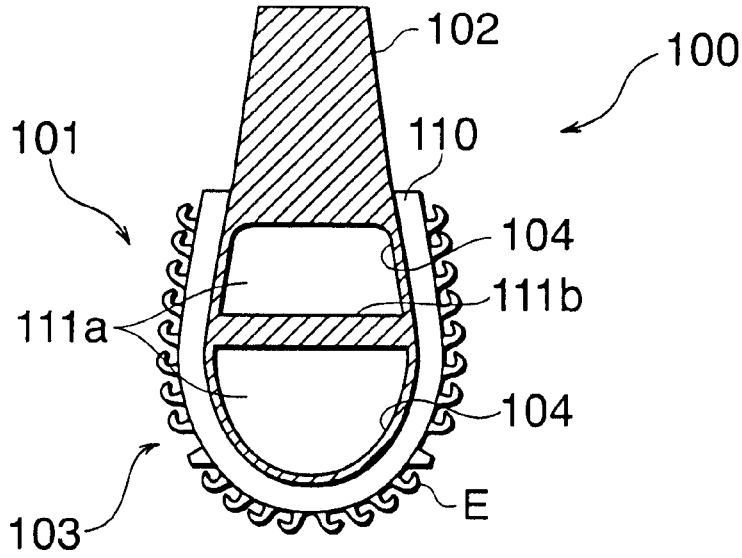
FIG. 5 is an arrow sectional view taken along the III—III line in FIG. 3.

Further, in the polishing operation, a extremely large oscillation acts on the fastening device 100 from the polishing machine 1 in many directions and further, the oscillation of the polishing machine 1 is very large, so that the oscillation is transmitted to a hand, an arm or the like of the operator and a reaction to act on the operator becomes very large. Therefore, according to the present embodiment, by forming the above described cavity portion 104, the flexibility of the fastening device 100 is secured. Further, as shown in FIG. 3 and FIG. 5, a plurality of concave grooves 110, which are continuously arranged in parallel with each other in the winding direction of the polishing paper cloth 11, are integrally formed at the non-engagement areas A1 to A3 and B without the surface fastener engaging element rows ER on the fastening device main body 101,.

By providing these concave grooves 110 and in cooperation with the cavity portion 104, flexibility is provided to the fastening device main body 101 so that the fastening device main body 101 can be easily deformed in many directions and the reaction to act on the operator, which is generated during the polishing, can be suppressed. In addition, according to the present embodiment, the concave grooves 110 are continuously arranged in parallel with each other in the winding direction of the polishing paper cloth 11 of the fastening device main body 101. However, the present invention is not limited to this. For example, the concave grooves 110 may be provided between the hook-shape engaging elements E comprising the surface fastener engaging element rows ER.

In the polishing operation by the polishing paper cloth 11, the engaging surface 103 formed of the hook-shaped engaging elements E and the rear surface of the polishing paper cloth 11, and the front surface of the polishing paper cloth 11 and a work piece are repeatedly rubbed with each other, so that a large amount of friction heat is generated. Then, the heat is transmitted to the fastening device main body 101, so that the fastening device main body itself also reaches a high temperature. According to the present embodiment, as described above, each of the concave grooves 110 has a width and a depth such that it does not contact the polishing paper cloth 11 in the polishing. Therefore, the outside air can be easily flown through these concave grooves and the contacts with the outside air supplied from the outside are increased. Thus, the concave grooves 110 have a cooling function for efficiently discharging a large amount of the friction heat generated by the repetition of rubbing as described above.

Further, the concave grooves 110 also have a function as a chip pocket for facilitating the discharge of the polishing waste or the like of the polishing paper cloth 11 and a work piece. A part of the polishing waste or the like generated in polishing comes to easily intrude into the concave grooves 110 and at the same time, depending on the oscillation of the polishing machine 1, a part of the polishing waste or the like is smoothly discharged from an upper part of the fastening device main body 101 to the outside. As a result, it becomes possible to prevent clogging due to adhesion of minute polishing waste and any damage of the process surface during the polishing in advance, as well as it is possible to maintain the engagement force of the polishing paper cloth 11 with respect to the engaging surface 103 of the fastening device main body 101 for a long term. Further, as described above, because a part of the polishing waste or the like during the polishing operation intrudes into the concave grooves 110 and is smoothly discharged to the outside, it is possible to suppress the friction heat generated when the engaging surface 103 of the fastening device main body 101 and the rear surface of the polishing paper cloth 11 and the like are rubbed with each other through the polishing waste and to prevent deformation of the fastening device main body 101 due to a large amount of friction heat.

Figure 6:
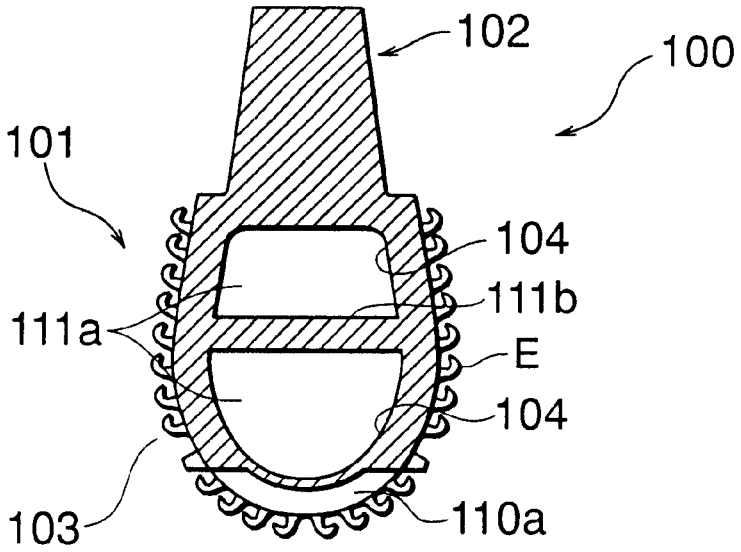
FIG. 6 is an arrow sectional view taken along the IV—IV line in FIG. 3.

Normally, the polishing operation is carried out by strongly pressing the fastening device main body 101 to a surface of a work piece and operating it along an exterior shape of the work piece. Therefore, during the polishing operation, it is the lower surface of the fastening device main body 101 that is pressed most strongly on the surface of the work piece. Accordingly, according to the present embodiment, a further single concave groove 110*a* is integrally formed at least on a substantially center portion of the lower surface of the fastening device main body 101, which is most affected by the polishing, other than the concave grooves 110, as shown in FIG. 3 and FIG. 6.

This concave groove 110*a* is provided in order to give a required elasticity to the lower surface, which is most affected by the polishing, of the fastening device main body 101, so that it is possible to prevent clogging or the like due to adhesion of the minute polishing waste during the polishing, as well as it is possible to secure a required engagement force with respect to the polishing paper cloth 11 even against the force to act in many directions. According to the present embodiment, for example, in the case that the concave groove 110*a* is provided so as to communicate with the concave grooves 110 for example, it becomes possible to improve the discharge rate of the polishing waste generated during the polishing and the cooling efficiency.

Figure 7:
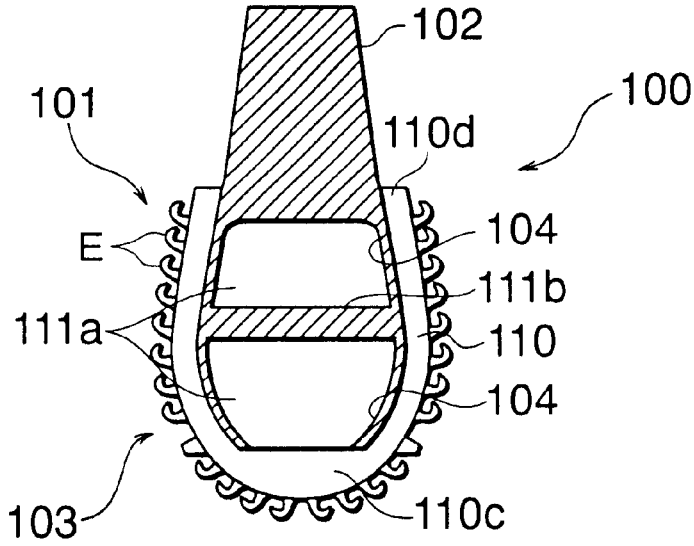
FIG. 7 is an arrow sectional view corresponding to the arrow section along the III—III line in FIG. 3, illustrating a modified example of a concave groove applied to the fastening device.
Figure 8:
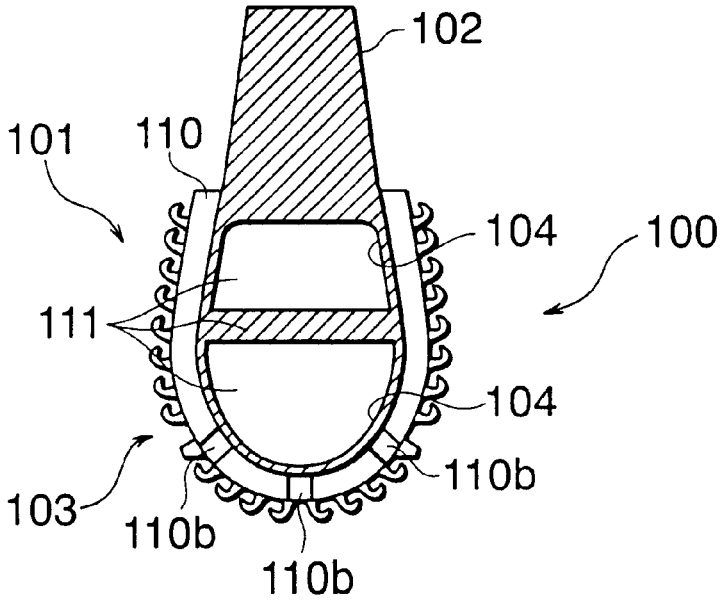
FIG. 8 is an arrow sectional view corresponding to the arrow section along the III—III line in FIG. 3, illustrating another modified example of a concave groove applied to the fastening device.

FIG. 7 and FIG. 8 show modified examples of the concave groove 110.

According to the modified example shown in FIG. 7, the concave grooves 110 formed on the surface of the fastening device main body 101 are not formed so as to be continuous in the winding direction of the polishing paper cloth 11, but each of the concave grooves 110 is divided into a concave groove 110*c* extending from a lower surface of the fastening device main body 101 to the both side surfaces thereof and a concave groove 110*d* extending from an upper end of the fastening device main body 101 to respective side surfaces. Further, a bottom surface of the concave groove 110 is cut off so as to communicated with the cavity portion 104. Hereby, the flexibility of the fastening device main body 101 is improved on the lower surface thereof. Further, with the border of the side surface of the fastening device main body 101, some of the minute polishing waste or the like intrude into the cavity portion 104 from the concave groove 110*c* to be discharged to the outside while the other intrude into the concave groove 110*d* to be discharged from the upper end of the fastening device main body 101, so that the polishing waste or the like is efficiently discharged.

According to the modified example shown in FIG. 8, on the lower surface of the fastening device main body 101, three concave grooves 110*b*, . . . , 110*b* are integrally formed, each of which is elongated in parallel with each other across the both end surfaces in the longitudinal direction so as to be orthogonal to the plurality of concave grooves 110 continuous in the winding direction of the polishing paper cloth 11. As described above, the concave groove 110*b* provides flexibility to the lower surface of the fastening device main body 101, which is most affected by the polishing, as well as it makes a part of the minute polishing waste or the like generated during the polishing intrude most easily. Furthermore, the concave groove 110*b* has a discharging function to flow the minute polishing waste or the like from the lower surface of the fastening device main body 101 upward by the oscillation of the polishing machine to discharge it to the outside. Therefore, the fastening device main body 101 prevents clogging by adhesion of the minute polishing waste and the friction heat or the like to be generated during the polishing.

FIG. 9 to FIG. 13 show modified examples of the fastening device 100, respectively. According to these modified examples, a shape of a section of the fastening device 100 is conformed to a shape of a portion of a work piece to be polished so as to secure easiness and accuracy in the polishing operation. In addition, in these modified examples, the same reference numerals are given to the portions corresponding to the respective portions according to the above described embodiment.

Figure 9A:
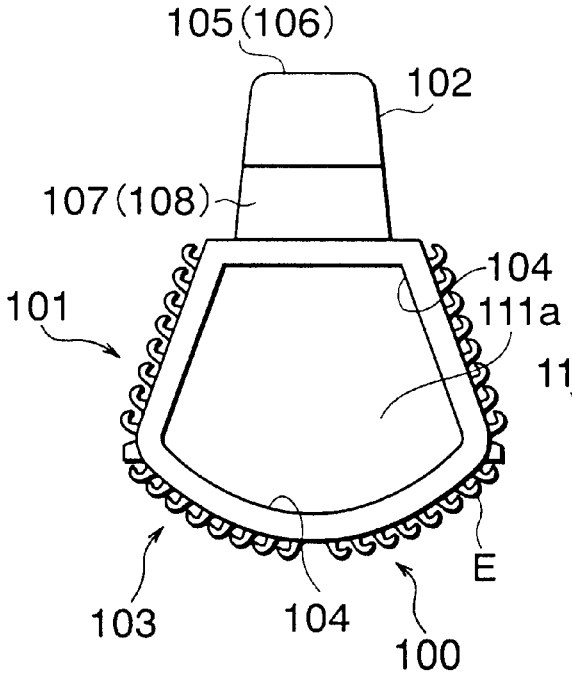
FIGS. 9A and 9B are a front view and a vertical sectional view for illustrating a modified example of the fastening device.
Figure 9B:
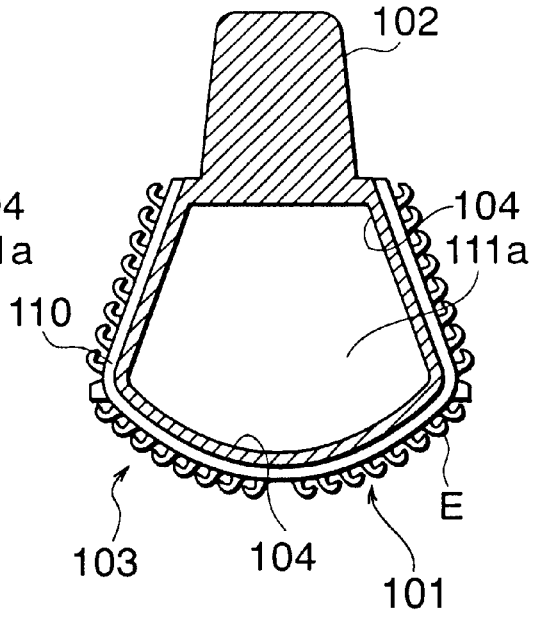

According to the modified example shown in FIG. 9, an outer shape of a section of the fastening device main body 101 of the fastening device 100 is a substantially fan. The cavity portion 104 having a section of a fan is formed extending from back and forth of the fastening device main body 101 in the longitudinal direction. Further, hook-shape surface fastener engaging element rows ER are provided so as to project on a circular portion of the lower surface and the right and left surfaces in FIG. 9. On the non-engagement areas A1 to A3 and B of these surface fastener engaging element rows ER, the concave grooves 110 are integrally formed, which are continuously arranged in the winding direction of the polishing paper cloth 11 in parallel with each other. The number of the hook-shape engaging elements E arranged in each surface fastener engaging element row ER is eight. There is formed a vertical wall 111*a* on a substantially center portion in the longitudinal direction of the cavity portion 104, so that the cavity portion 104 is partitioned into right and left two chambers by the vertical wall 111*a*.

Figure 10A:
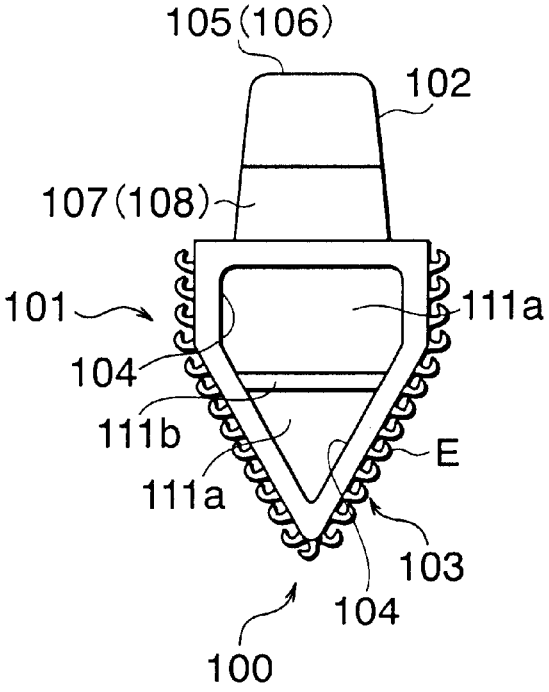
FIGS. 10A and 10B are a front view and a vertical sectional view for illustrating another modified example of the fastening device.
Figure 10B:
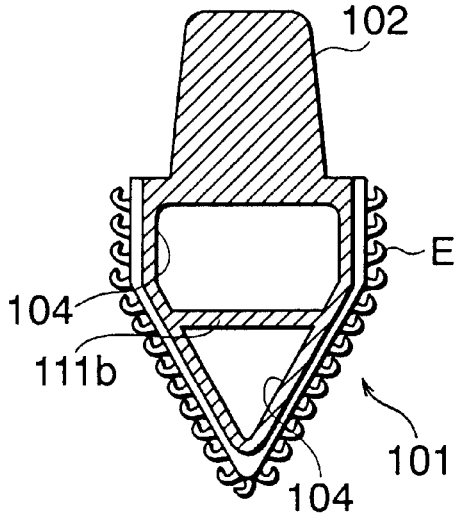

According to the modified example shown in FIG. 10, an outer shape of the section of the fastening device main body 101 is a united form of a substantially inverted isosceles triangle and a long and narrow rectangle formed by being elongated from the base of the inverted isosceles triangle upwards. The surface fastener engaging element rows ER are formed on its front surface and its top. The concave grooves 110 are integrally formed on the non-engagement areas A1 to A3 and B of these surface fastener engaging element rows ER, such that they are continuous in the winding direction of the polishing paper cloth 11 in parallel with each other. In the illustrated example, there are formed a vertical wall 111*a* on a substantially center portion in the longitudinal direction and a cavity portion 104, which is partitioned by a horizontal wall 111*b* formed along the longitudinal direction. The cavity portion 104 is partitioned into four chambers, namely, upper, lower, right and left chambers, at the substantially center portion in the longitudinal direction thereof.

Figure 11A:
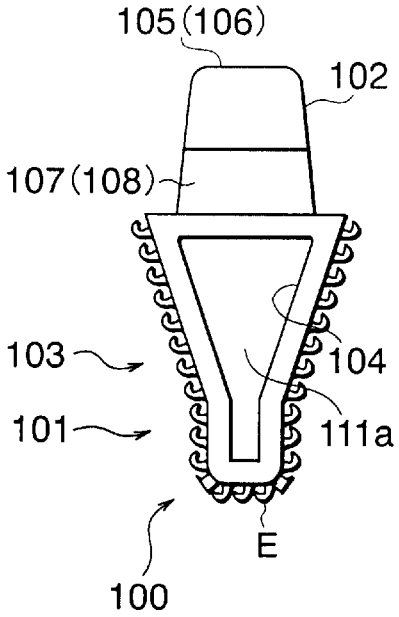
FIGS. 11A and 11B are a front view and a vertical sectional view for illustrating still another modified example of the fastening device.
Figure 11B:
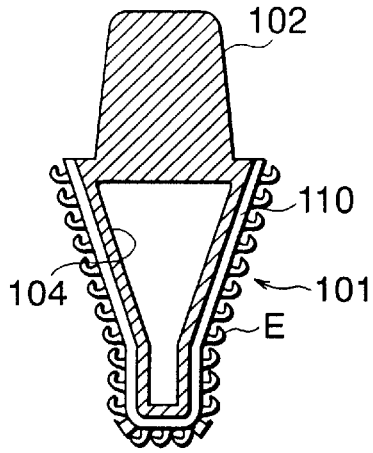

According to the modified example shown in FIG. 11, an outer shape of a section of the fastening device main body 101 is a united form of a substantially inverted isosceles triangle and a long and narrow rectangle which is elongated from a middle part of a top of the inverted isosceles triangle downwards. The surface fastener engaging element rows ER are formed on its front surface and its lower surface. On the non-engagement areas A1 to A3 and B of the surface fastener engaging element rows ER, the concave grooves 110 are integrally formed, which are continuous in the winding direction of the polishing paper cloth 11 in parallel with each other.

Figure 12A:
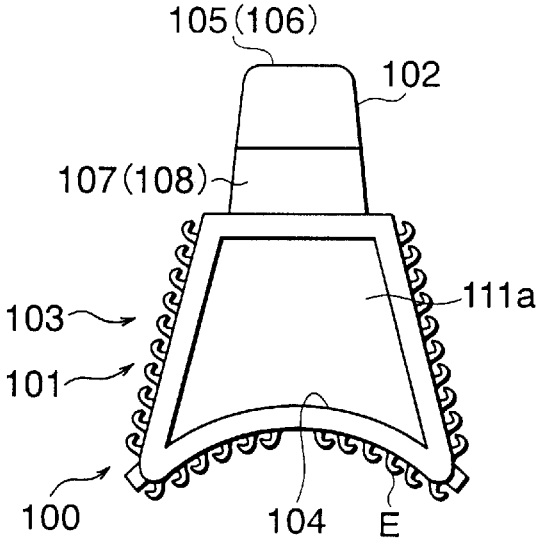
FIGS. 12A and 12B are a front view and a vertical sectional view for illustrating still another modified example of the fastening device.
Figure 12B:
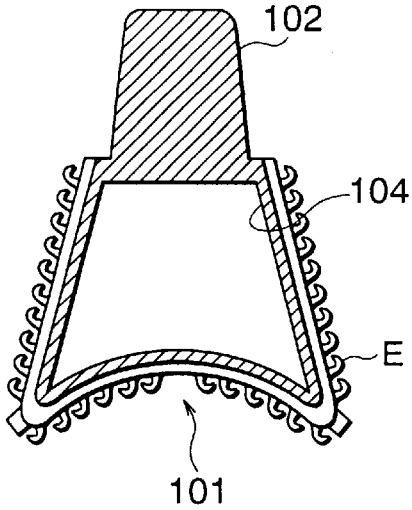
Figure 13A:
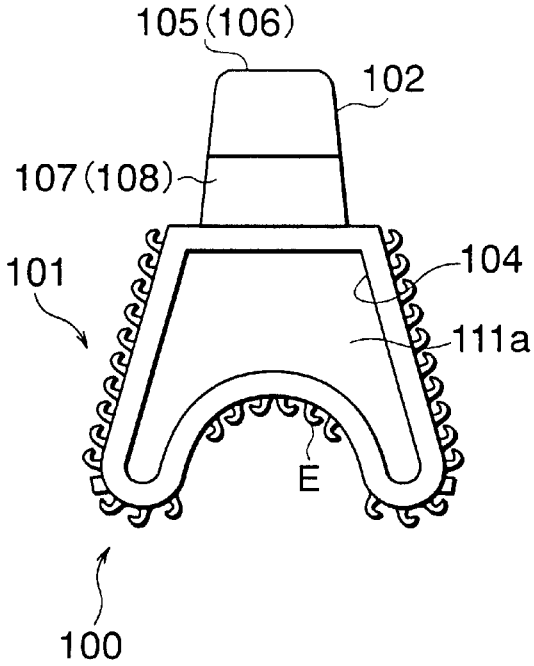
FIGS. 13A and 13B are a front view and a vertical sectional view for illustrating still another modified example of the fastening device.
Figure 13B:
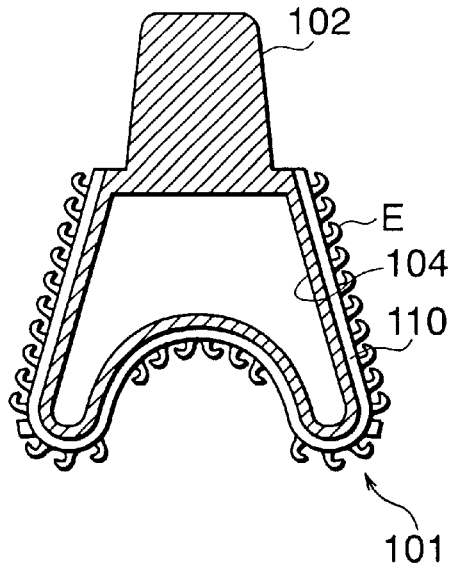

According to the modified examples shown in FIG. 12 and FIG. 13, a section of the fastening device main body 101 is a curved surface in which a base portion of a substantially trapezoid curves to the inside in an arc shape and curvature radiuses of the curved surfaces are different. Further, according to the modified example shown in FIG. 12, a cavity portion 104 of a substantially trapezoid is formed along the center line. The surface fastener engaging element rows ER are formed on its front surface and a lower surface. On the non-engagement areas A1 to A3 and B of these surface fastener engaging element rows ER, the concave grooves 110 are integrally formed, which are continuous in the winding direction of the polishing paper cloth 11 in parallel with each other.

Further, according to the modified examples shown both in FIG. 12 and FIG. 13, the surface fastener engaging element rows ER are formed also on the curved surface in addition to the right and left side surfaces so as to constitute the engaging surface 103. Furthermore, according to both of the modified examples shown in FIG. 12 and FIG. 13, the hooks of the hook-shape engaging elements E, which are arranged in the respective surface fastener engaging element rows ER formed on the curved surfaces, are oriented in an opposite direction to each other from a center line of the curved surfaces. Further, in the fastening device 100 shown in FIG. 12, the engaging surface 103, which is comprised of a plurality of surface fastener engaging element rows ER formed on the curved surface, is formed over the curved surface. On the contrary, in the fastening device 100 shown in FIG. 13, the engaging surface 103 is formed on the center portion of the curved surface. This is because a shape of a section of the fastening device 100 is conformed to a shape of a portion of a work piece to be polished as well as the engagement force of the polishing paper cloth 11 is strengthened by a portion to be polished.

Figure 14:
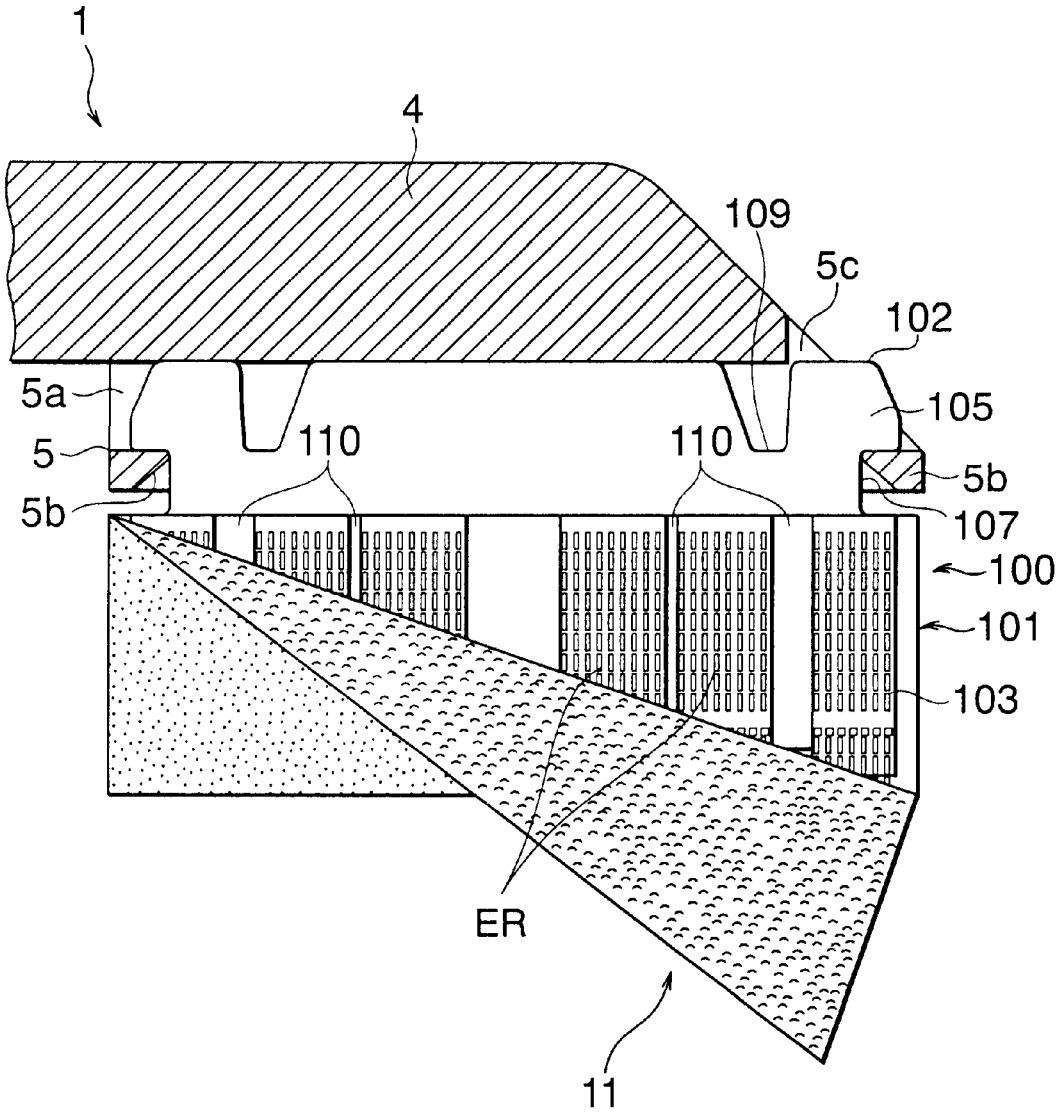
FIG. 14 is a side view for illustrating the manner in which the fastening device is attached to a base plate of a polishing machine and the manner in which the polishing cloth paper is fixed on an engaging surface of the fastening device.

FIG. 14 illustrates a manner that the fastening device 100 having such a structure as described above is attached to the base plate 2 of the polishing machine 1 and a state that the polishing paper cloth 11 is winded on the fastening device main body 101 of the fastening device 100 to be engaged therewith.

In order to attach the fastening device 100 to the attachment and detachment portion 5 for the fastening device, which is formed on the base plate anterior part 4*b* of the polishing machine 1, the fastening device 100 is attached as shown in FIG. 14 by letting a pair of back and forth engaging and disengaging projections 105, 106 of the fastening device 100 elastically deform respectively, and pushing them into the fitting hole 5*c* via the engaging nail 5*b* formed in the vicinity of the attachment and detachment portion 5 to be fixed therewith. On the other hand, a female surface fastener having a multiplicity of densely-arranged loops is attached on a rear surface of the polishing paper cloth 11. The female surface fastener is winded on and along the engaging surface 103 of the fastening device 100 and fix thereto by pressing. When the fastening device 100 is to be taken out from the attachment and detachment portion 5 of the base plate 4, the fastening device main body 101 of the fastening device 100 is grasped and the respective projections 105 and 106 are pulled out of the fitting hole 5*c* and the engaging nail 5*b* to be removed therefrom. Then, the respective projections 105 and 106 are elastically bent at the penetrating grooves 109. As a result, it is possible to easily take out the fastening device 100 from the attachment and detachment portion 5 of the base plate 4.

In this way, according to the fastening device 100 for the polishing paper cloth 11 according to the present invention, there are formed a plurality of concave grooves 110, which are provided on a surface of the fastening device main body 101 and continuous in the winding direction of the polishing paper cloth 11 as well a cavity portion 104 which is elongated to the inside of the fastening device main body 101. Therefore, flexibility is provided to the fastening device main body 101 such that the fastening device main body 101 is easily deformed in many directions and it becomes possible to prevent a reaction acting on the operator due to the oscillation of the polishing machine 1 generated during the polishing operation. Further, the concave grooves 110 have a discharging function for allowing the polishing waste generated during the polishing to easily intrude therein and easily discharging the polishing waste to the outside. Therefore, even during the polishing, the outer air is easily flown through the concave groove 110 and the contacts with the outside air to be supplied from the outside are increased, so that it becomes possible to improve the discharge efficiency of the friction heat to be generated during the polishing.

Still further, since it is possible to integrally mold the surface fastener engaging element rows ER at random on predetermined positions of the surface of the fastening device main body 101 of the fastening device 100, it becomes possible to accurately form the engaging surface 103 of the surface fastener engaging element rows ER only at the portions required to secure the engagement strength with respect to the polishing paper cloth 11. Therefore, since the engaging surface 103 is not formed on the portions not requiring to secure the engagement strength, a manufacturing cost thereof can be decreased.

A typical embodiment and the modified examples of the present invention are as described above. However, the present invention is not limited to these embodiments. For example, the hook-shape engaging element E as a constituent member of the surface fastener engaging element row ER, which is formed on the fastening device 100, is not limited to the illustrated shape. It may be understood that the present invention can be variously modified within the range that does not deviate from the spirit of the present invention.

What is claimed:

1. A fastening device for a polishing paper cloth capable of being detached from and attached to a base plate of a polishing machine, wherein the fastening device has a fastening device main body made of synthetic resin, said fastening device main body comprises an attaching portion capable of being detached from and attached to the base plate of the polishing machine and an engaging surface for directly wrapping the polishing paper cloth thereon to engage therewith, and the fastening device main body has the engaging surface and a plurality of concave grooves on a surface thereof.

2. The fastening device for a polishing paper cloth according to claim 1, wherein the concave grooves are formed so as to extend in a direction perpendicular to a longitudinal direction of said fastening device main body.

3. The fastening device for a polishing paper cloth according to claim 2, wherein the fastening device main body further has a second concave groove formed on a lower surface of said fastening device main body, the lower surface being located opposite to said attaching portion.

4. The fastening device for a polishing paper cloth according to claim 3, wherein the second concave groove formed on said lower surface extends toward opposite side surfaces of the fastening device main body, between said attaching portion and said lower surface of said fastening device main body.

5. The fastening device for a polishing paper cloth according to claim 1, wherein the fastening device main body has a cavity portion having openings at end surfaces in a longitudinal direction of the fastening device main body and that a thickness between the cavity portion and the engaging surface is substantially uniform in a direction perpendicular to a longitudinal direction of said fastening device main body.

6. The fastening device for a polishing paper cloth according to claim 1, wherein the fastening device main body has a cavity portion having openings at end surfaces in a longitudinal direction of the fastening device main body, and the cavity portion is partitioned at a center portion in the longitudinal direction by a vertical wall.

7. The fastening device for a polishing paper cloth according to claim 6, wherein an interior of the cavity portion is further partitioned by a horizontal wall.

8. The fastening device for a polishing paper cloth according to claim 1, wherein plural surface fastener engaging elements are molded integrally on said engaging surface.

9. The fastening device for a polishing paper cloth according to claim 1, wherein surface fastener engaging elements having hooks are molded integrally on said engaging surface in rows so as to be arranged in a direction perpendicular to a longitudinal direction of said fastening device main body, the rows of surface fastener engaging elements being arranged in groups on said engaging surface in longitudinal direction of said fastening device main body.

* * * * *